US005984406A

United States Patent [19]

Lee

[11] Patent Number: 5,984,406

[45] Date of Patent: Nov. 16, 1999

[54] FOLDING CHAIR

[76] Inventor: Howard Lee, 1325 Oakhill Pl., South Pasadena, Calif. 91030

[21] Appl. No.: 08/995,665

[22] Filed: Dec. 22, 1997

Related U.S. Application Data

[63] Continuation of application No. 08/857,309, May 16, 1997.

[51] Int. Cl.[6] ..... A47C 4/00

[52] U.S. Cl. ..... 297/16.2; 297/42; 297/45

[58] Field of Search ..... 297/16.2, 16.1, 297/35, 39, 42, 45, 46, 59; 248/436

[56] References Cited

U.S. PATENT DOCUMENTS

| | | | |
|---|---|---|---|
| 2,702,586 | 2/1955 | Borgfeldt | 297/45 X |
| 3,124,387 | 3/1964 | Maclaren | 297/45 X |
| 3,136,272 | 6/1964 | Sprigman . | |
| 3,635,520 | 1/1972 | Roher et al. . | |
| 5,570,928 | 11/1996 | Staunton et al. | 297/45 X |

FOREIGN PATENT DOCUMENTS

| | | | |
|---|---|---|---|
| 6197821 | 7/1994 | Japan | 297/16.2 |

*Primary Examiner*—Laurie K. Cranmer
*Attorney, Agent, or Firm*—Darby & Darby, P.C.

[57] ABSTRACT

A folding chair having: a frame consisting of a pair of front crossed legs; a pair of back crossed legs; and two pairs of side crossed legs, each pair of crossed legs pivotally connected together where they cross. The lower ends of the front legs and the lower, front ends of the side legs are pivotally connected to first and second lower, front pads. The lower ends of the back legs and the lower, back ends of the side legs are pivotally connected to first and second lower, back pads. The upper ends of the back legs and the upper, back ends of the side legs are pivotally connected to first and second upper, back pads. The upper ends of the front legs and the upper, front ends of the side legs are pivotally connected to first and second upper, front pads. The upper ends of the front legs slidably pass through the first and second upper front pads, the upper ends bent to form hand rests above the upper front pads. The upper, front, ends of the side legs are pivotally connected to the upper front pads. Flexible seat means are connected to the frame with the corners at the four upper pads.

7 Claims, 6 Drawing Sheets

FIG. 4
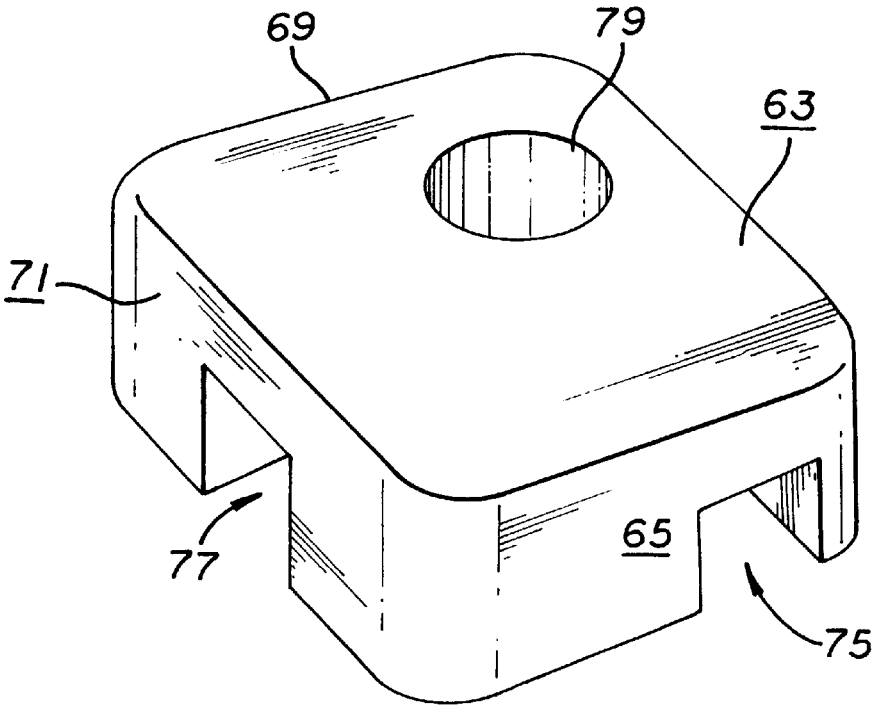
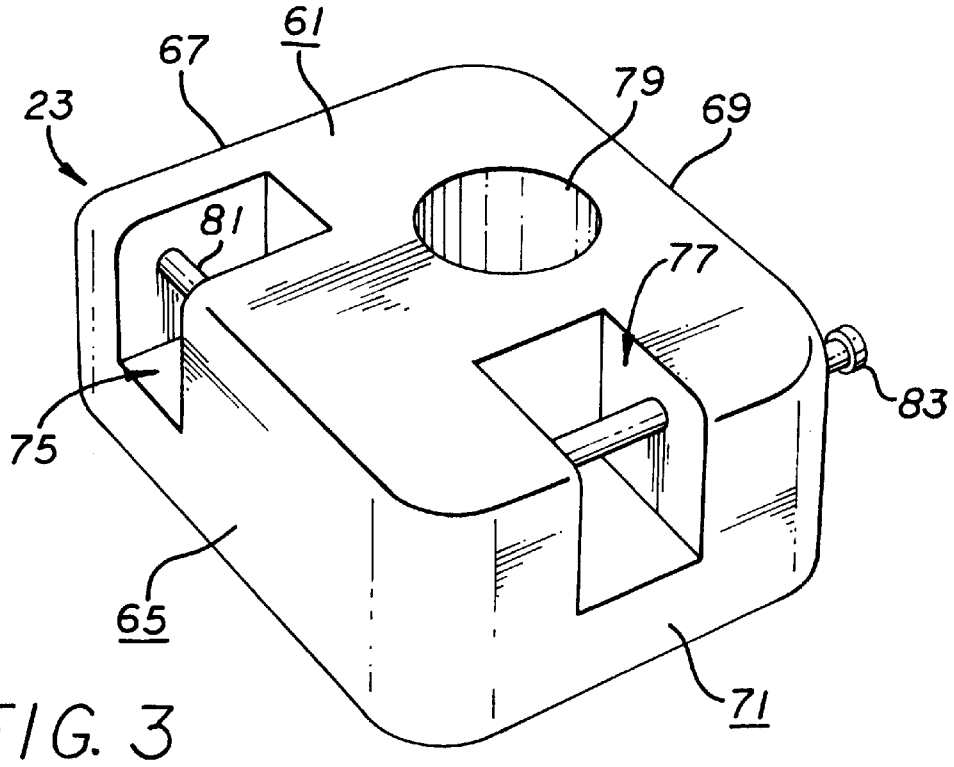
FIG. 3

FIG. 10
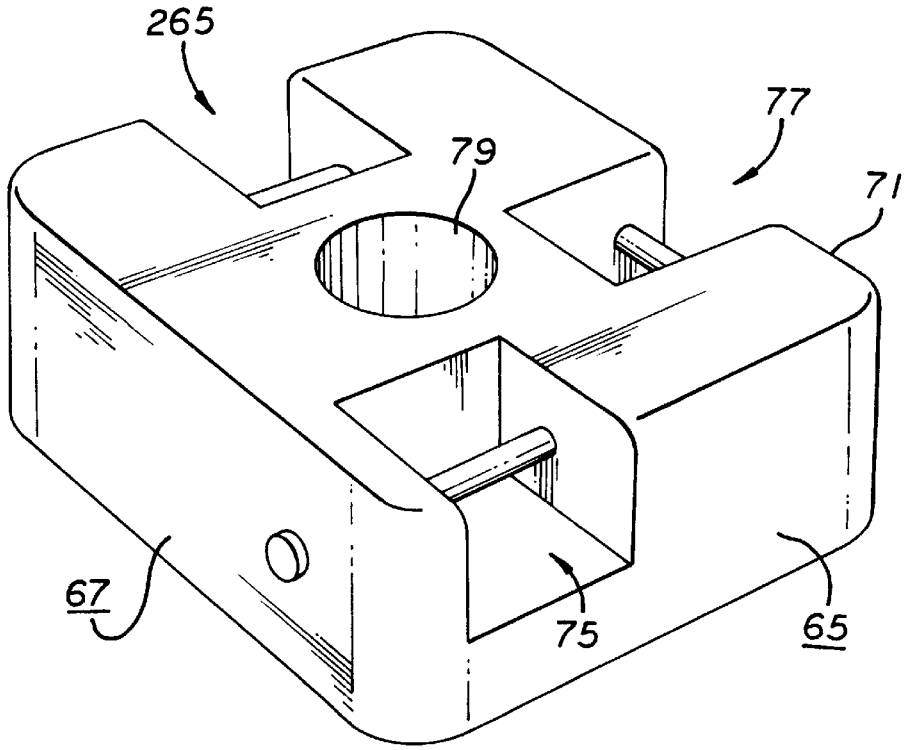
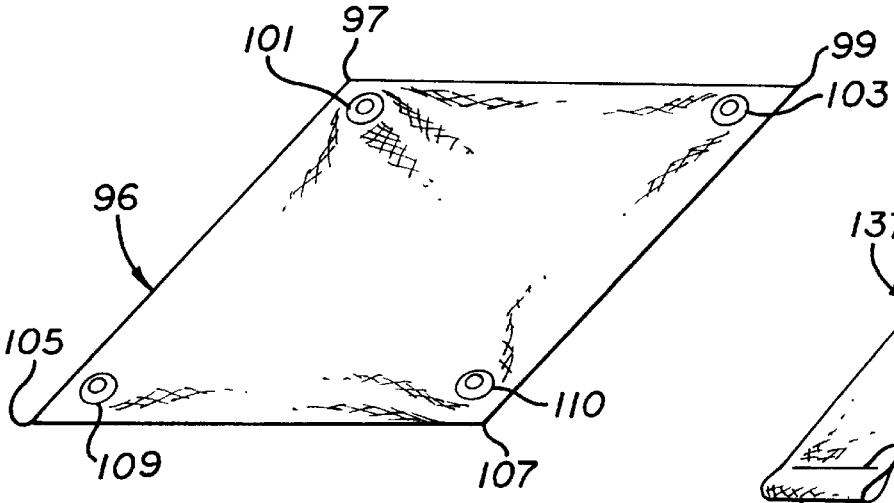
FIG. 6
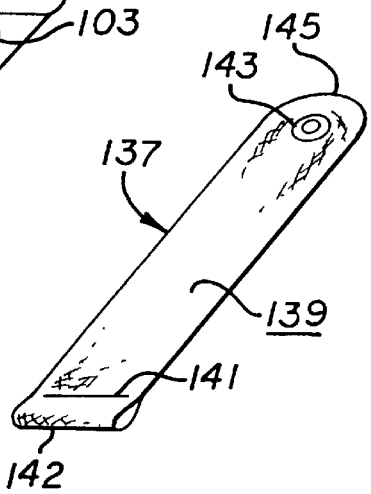
FIG. 8

FOLDING CHAIR

This application is a continuation of application Ser. No. 08/857,309 filed on May 16, 1997 still pending.

BACKGROUND OF THE INVENTION

1. Field of the Invention

This invention is directed toward folding furniture. The invention is more particularly directed toward a folding chair. The invention is also directed toward a connector pad for use in folding furniture, and particularly in a folding chair.

2. Description of the Related Art Including Information Disclosed Under CFR §§ 1.97–1.99

Folding chairs are generally of the type where the seat folds relative to the back of the chair. Thus the size of the chair is reduced in depth or in the Y direction. Such a folded chair still takes up a relatively large amount of space however since the width of the chair, in the X direction, has not been reduced.

It is known to provide folding chairs of the type which fold in both the X and Y directions to reduce the space taken up by the chairs. Examples of such chairs are shown in U.S. Pat. Nos. 3,136,272 and 3,635,520 by way of example. These known chairs are however somewhat complicated in construction, particularly in providing arm rests and back rests. The chairs are also awkward and difficult to fold and unfold when provided with arm rests and back rests. The back rests provided by the known chairs are also not very strong. The known chairs are also not adapted to seat more than one person at a time.

SUMMARY OF THE INVENTION

It is the purpose of the present invention to provide a folding chair of the type which folds in both the X and Y directions which chair is easy to fold and unfold. It is another purpose of the present invention to provide a folding chair which is simply constructed to provide hand rests which can also be used in folding and unfolding the chair. It is a further purpose of the present invention to provide a folding chair which has a relatively strong back rest. It is another purpose of the present invention to provide a folding chair which can seat more than one person. It is a further purpose of the present invention to provide connector pads for use in folding chairs which pads provide good support for the chair and are multi-functional in use in the chair.

In accordance with the present invention there is provided a folding chair constructed to fold in both the X and Y directions of the chair, the chair being provided with hand rests that aid in easily folding and unfolding the chair. The hand rests are located at the front of the chair, above the seat of the chair, and form a part of the arm rests of the chair. The hand rests comprise part of the frame of the chair and, acting as levers, make the folding and unfolding operation easier.

The folding chair of the present invention is also provided with a simple yet strong back rest in the unfolded position. The back rest of the chair is anchored at both the bottom of the chair and at the seat level forming a strong support for a person's back. The parts forming the back rest fold and unfold easily with the rest of the chair.

The folding chair of the present invention can also be easily constructed to seat more than one person. The chair can be provided with framework for seating two people side-by-side, the framework providing support for double back rests and arm rests. The double seat chair is easily folded and unfolded. Outside hand rests again act as levers in folding or unfolding the chair making the operation easier. The back rests of the double chair are simple yet strong in construction, again being anchored at both the bottom of the chair and at seat level.

The folding chair, whether with a single or double seat, employs a frame made from pairs of crossed legs which are pivotally connected together where they cross. The crossed legs form the front, back and sides of the chair and are joined together at the top and bottom by connector pads. The legs are pivotally connected to the connector pads allowing the legs to move toward a folded position, where they are nearly parallel, from their unfolded, crossed position so that the chair easily folds. The bottom connector pads provide stable footing for the chair when unfolded. The majority of the pads are identical in construction making the chair relatively inexpensive to produce. The seat and back of the chair is made of flexible material permitting the chair to fold and unfold.

The invention is particularly directed toward a folding chair having a frame consisting of; a pair of front crossed legs, a pair of back crossed legs, and two pairs of side legs. Each pair of the crossed legs are pivotally connected together where they cross. The lower ends of the front legs and the lower, front ends of the side legs are pivotally connected to first and second lower, front pads. The lower ends of the back legs and the lower, back ends of the side legs are pivotally connected to first and second lower, back pads. The upper ends of the back legs and the upper, back ends of the side legs are pivotally connected to first and second upper, back pads. The upper ends of the front legs and the upper, front ends of the side legs are connected to first and second upper, front pads. The upper ends of the front legs slidably pass through the first and second upper front pads, the upper ends bent to form hand rests above the upper front pads. The upper, front, ends of the side legs are pivotally connected to the upper front pads.

The invention is also directed toward a connector pad for use in a folding chair, the pad having parallel, generally quadratic, main faces joined by four side faces. A hole extends through the pad transversely between the main faces. A first slot extends inwardly from one main face and one side face, the slot parallel to a second side face adjacent the one side face. A second slot extends inwardly from the one main face and the second side face, adjacent the one side face, the second slot transverse to the first slot. The slots are just wide enough to receive frame legs.

BRIEF DESCRIPTION OF THE DRAWINGS

FIG. 3 is a top perspective view of a connector pad;

FIG. 4 is a bottom perspective view of a connector pad;

FIG. 6 is a perspective view of a seat used in the folding chair;

FIG. 8 is a perspective view of an arm rest used in the folding chair;

FIG. 10 is a perspective view of a modified connector pad used in the two seat folding chair.

DESCRIPTION OF THE PREFERRED EMBODIMENTS

Figure 2:
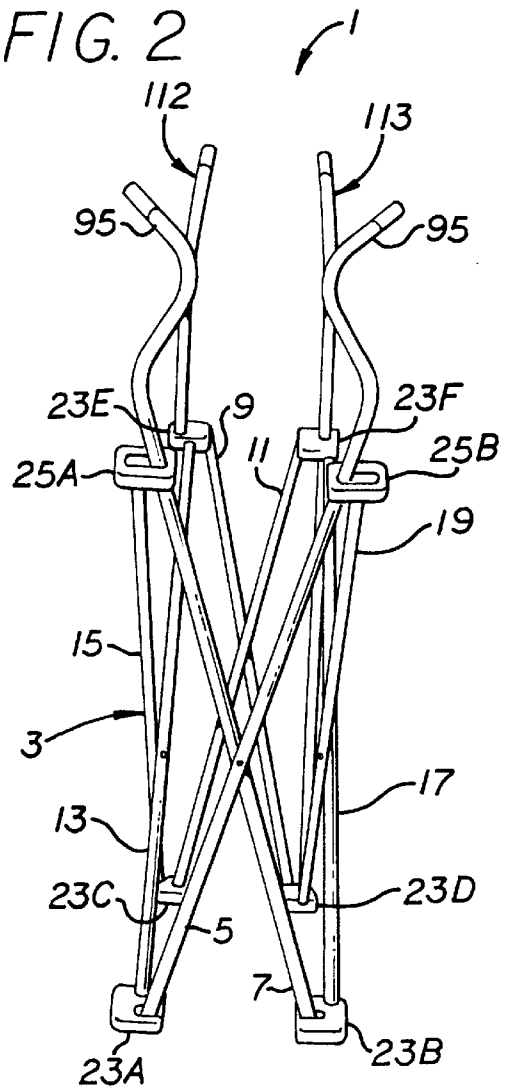
FIG. 2 is a perspective front view of the folding chair in a folded position.
Figure 1:
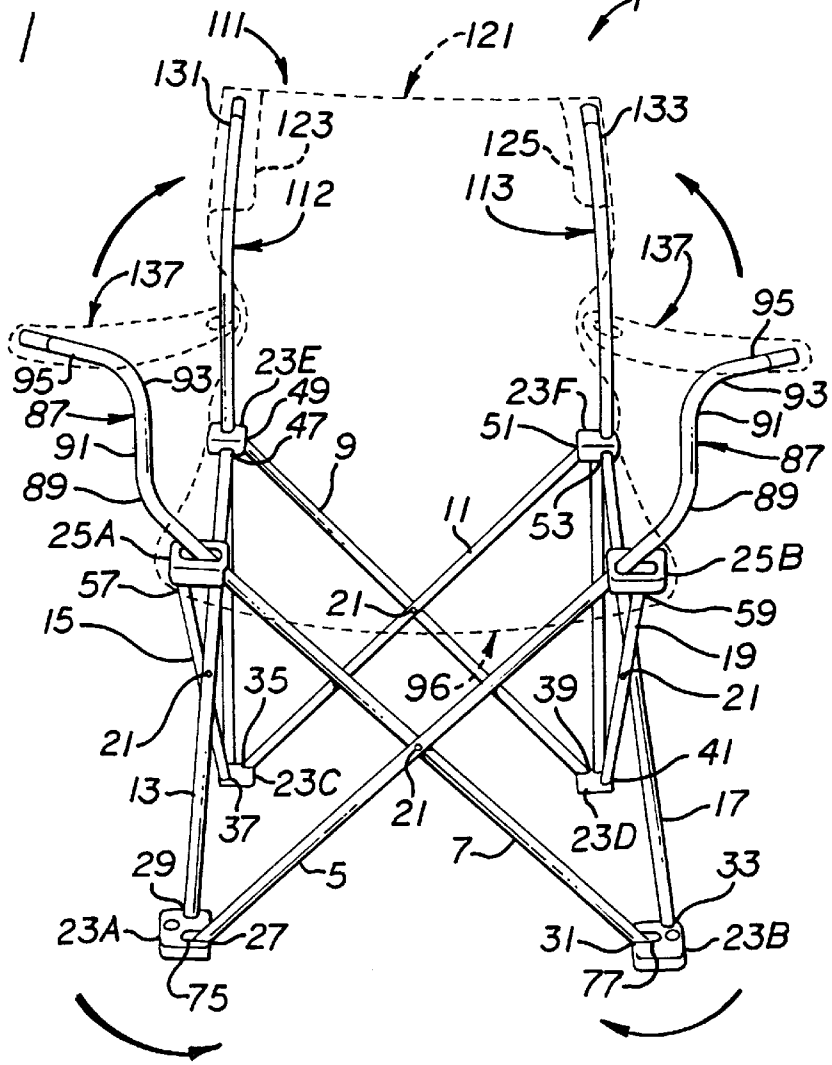
FIG. 1 is a perspective front view of the folding chair in an unfolded position.
Figure 1A:
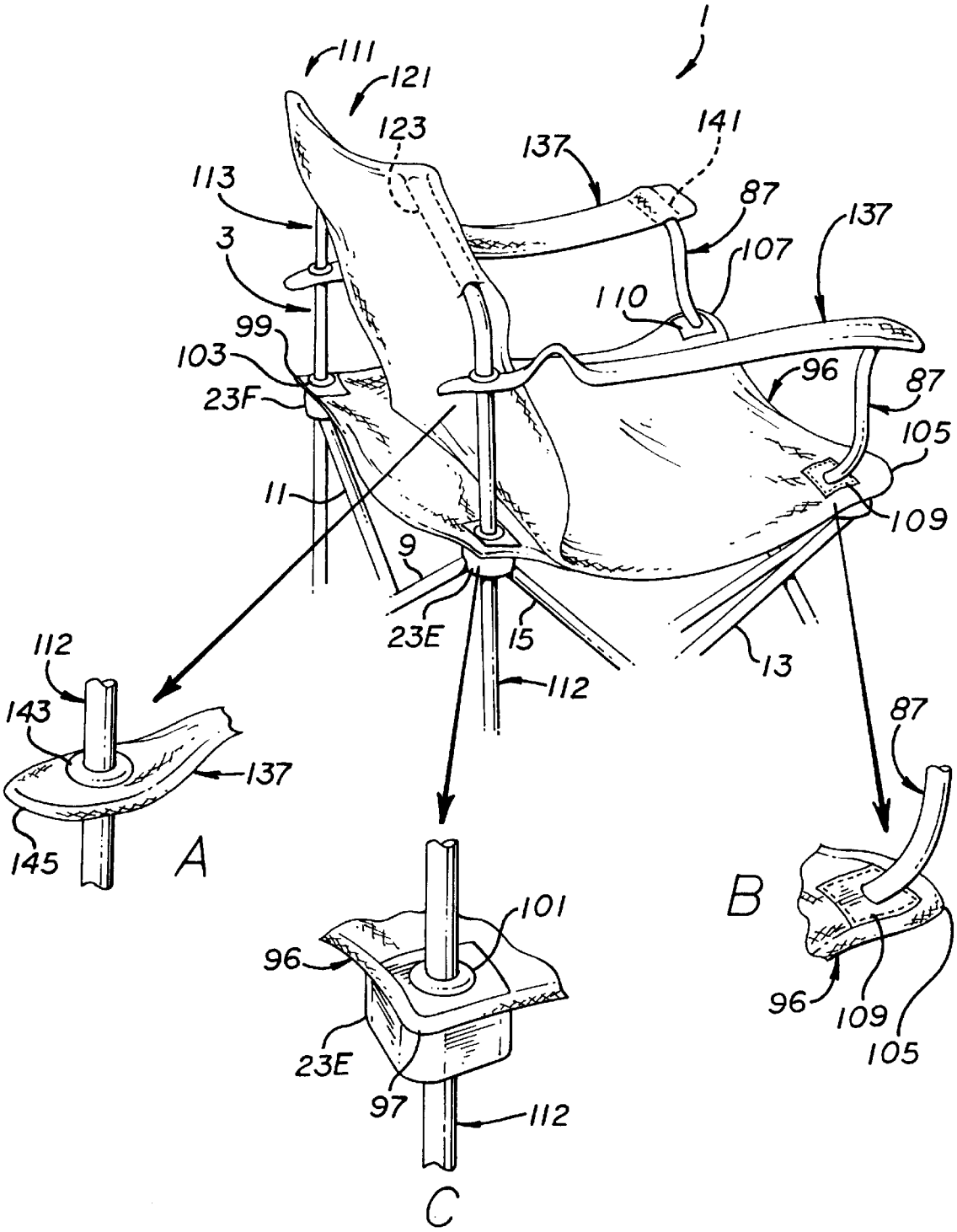
FIG. 1A is a rear perspective view of the chair, unfolded, showing details of the seat and arm rest supports.

The folding chair 1 of the present invention, as shown in FIGS. 1, 1A and 2, has a frame 3 made from tubular members or legs. The frame has a pair of front crossed legs 5,7; a pair of back crossed legs 9,11; and two pairs of side crossed legs 13, 15 and 17, 19. Each pair of crossed legs are pivotally joined together at their approximate centers by a pivot pin 21. The upper and lower ends of the pairs of crossed legs are connected together using connector pads 23, 25. Six connector pads 23 are provided, one at each lower corner of the chair and one at each upper, rear corner of the chair with the chair in the unfolded position. One of the lower, front connector pads 23A connects the lower end 27 of a front leg 5 to the lower front end 29 of one of the side legs 13 of one side pair. Another of the lower, front connector pads 23B connects the lower end 31 of the other front leg 7 to the lower front end 33 of one of the side legs 17 of the other side pair. A lower, back connector pad 23C connects the lower end 35 of a back leg 11 to the lower, back end 37 of the other side leg 15 of the one side pair. A second lower, back connector pad 23D connects the lower end 39 of the other back leg 9 to the lower, back end 41 of the other side leg 19 of the other side pair. A top, back connector pad 23E connects the upper end 47 of the one side leg 13 of the one side pair to the upper end 49 of the other back leg 9 and a second top, back connector pad 23F connects the upper end 51 of the one back leg 11 to the upper end 53 of the one leg 17 of the other side pair. All the connections are pivot connections.

A top, front connector pad 25A connects the upper portion of the other front leg 7 to the upper, front end 57 of the other side leg 15 of the one side pair. A second top, front connector pad 25B connects the upper portion of the one front leg 5 to the upper, front end 59 of the other side leg 19 of the other side pair.

The six connector pads 23A to 23F are identical and, as shown in FIGS. 3 and 4, each pad comprises a pair of parallel main quadratic surfaces 61, 63 joined by four side surfaces 65, 67, 69 and 71 serially connected together. The main surfaces 61, 63 are preferably square in shape and the side surfaces 65 to 71 are rectangular with the corners where the side surfaces join each other being rounded. Each pad 23 has a first slot 75 extending into the pad from one main surface 61 and one side surface 65. This first slot 75 is located closely adjacent to a side surface 67 adjacent the one side surface 65. A second slot 77 also extends into the pad from the one main surface 61 and the other side surface 71 adjacent the one side surface 65. This second slot 77 is transverse to the first slot 75 and is located in the center of the other side surface 71 between the one side surface 65 and the other side surface 69 adjacent to the other side surface 71. The pad also has a through hole 79 that extends between the main surfaces 61, 63. The hole 79 is adjacent the corner defined by the sides 67, 69 of the pad.

Each slot 75, 77 is wide enough to snugly receive one of the legs 5 to 19. The leg fits into the slot 75 or 77 and a pin 81 or 83 is passed through the pad 23 from one side wall, and through the leg, to pivotally connect the leg to the pad. The slots 75, 77 are sized to allow the leg to swing within the slot thereby allowing the stool to fold and unfold. The through hole 79 is sized to slidably receive a leg.

The bottom pads 23A to 23D are mounted on the legs with the main surface 61 having the slots 75, 77 facing up and the top pads 23E, 23F are mounted on the legs with the main surface 61 facing down. The sides of the pads 23 are about three times as long as the diameter of the legs so that the offset slot 75 adjacent one of the side surfaces is spaced the width of one leg from the centered slot 77 when the slots face each other in adjacent pads. Having one of the slots 75 offset laterally on its side face and the other slot 77 centered in its side face accommodates the crossed leg pairs which are offset relative to each other. Looking for example at the mounting of the crossed front legs 5, 7 in FIG. 1, the lower end 27 of leg 5 is mounted in the offset slot 75 of its pad 23A while the lower end 31 of the crossed leg 7 is mounted in the centered slot 77 of its pad 23B. Thus the legs 5, 7 do not have to be bent to obtain a square base formed by the pads in the unfolded position of the stool.

Figure 5A:
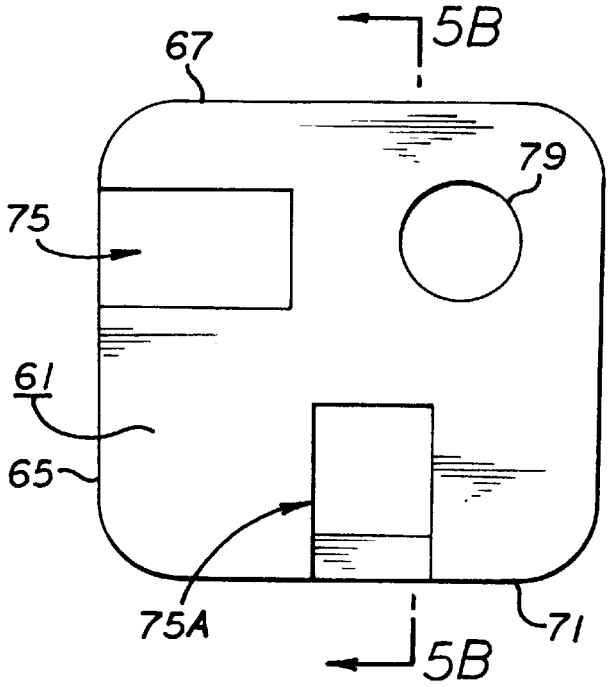
FIG. 5A is a top view of a modified connector pad.
Figure 5B:
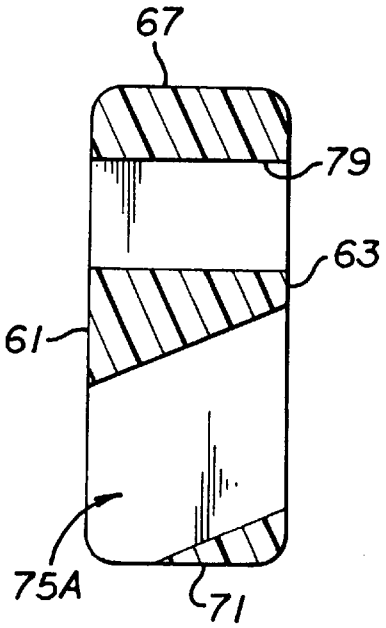
FIG. 5B is a cross-section view taken along line 5B—5B in FIG. 5A.

The chair 1 is provided with hand rests. To this end the front legs 5,7 are each provided with extensions 87 as shown in FIGS. 1 and 2, that extend through the front, upper pads 25A, 25B. Each extension 87 can be bent slightly at 89 to have an upward extending portion 91 above the pads 25A, 25B and then bent again at 93 to have a transverse extending hand rest 95. The front, upper pads 25A, 25B are similar to the other connector pads 23 except that they are modified to have the slot 75A extend through the pads 25, as shown in FIGS. 5A and 5B, so that the extensions 87 on the front legs 5, 7 slidably pass through the pads 25. The front legs 5, 7 are not pinned to the pads 25. The hand rests 95 on the extensions 87 extend generally parallel to the front of the chair. The hand rests 95 provide means for easily folding and unfolding the chair, providing good leverage for causing the legs to pivot apart or together simultaneously in both the X and Y directions.

A seat 96 made of flexible material can be mounted on the frame 3. The seat 96 is generally square in shape as shown in FIG. 6, and is attached at its rear corners 97, 99 by suitable pin means (not shown) passed through grommets 101, 103 in the corners 97, 99. The pins have enlarged heads so they do not pass through the grommets. The shank of the pins passes through the holes 79 in the top, rear connector pads 23E, 23F. Suitable means (not shown) connect the pins to the pads 23E, 23F. The front corners 105, 107 of the seat 96 have grommets 109, 110, located therein so that the front corners of the seat can be slipped over the extensions 87 of the front legs 5, 7, the grommets 109, 110 resting on the upper, front connector pads 25A, 25B. The seat 96 limits the unfolding of the chair and when the chair is folded up, the seat folds as well.

The chair described above can be used as is. Preferably, however, the chair 1 has a back rest 111 as well. In this embodiment, the frame 3 of the chair 1 includes two additional back legs 112, 113 used to define the back rest 111 as shown in FIGS. 1 and 2. These back legs 112, 113 are longer than the crossed pairs of legs and extend vertically at the back of the chair. The back legs 112, 113 slide through the holes 79 in the upper back pads 23E, 23F and are inserted in the through holes in the lower back pads 23C, 23D. The legs 112, 113 are pinned to the pads 23C, 23D.

Figure 7:
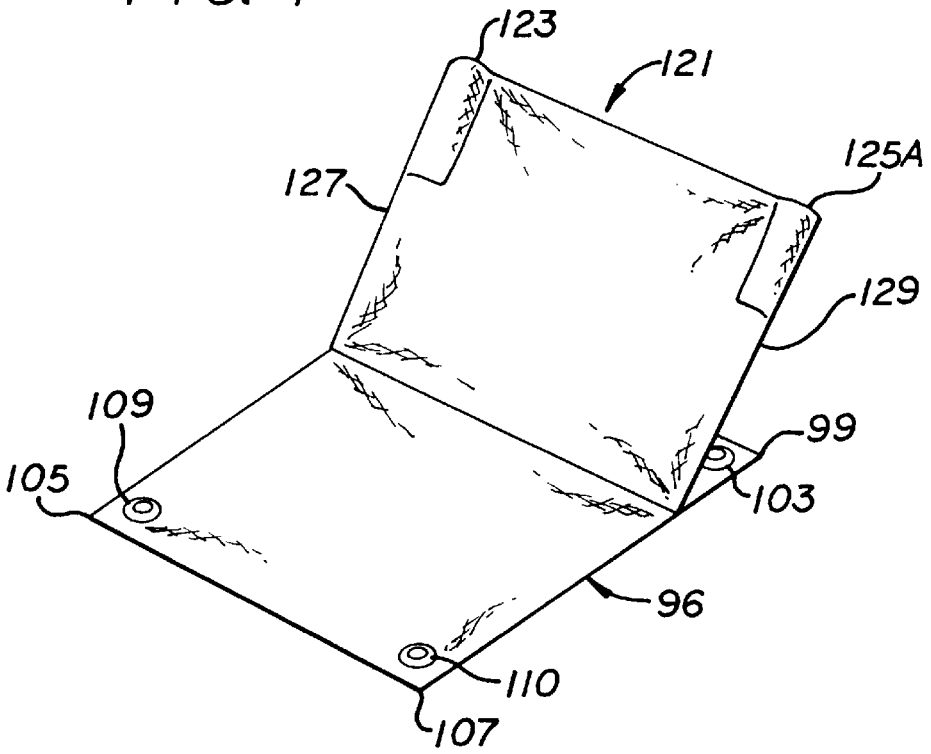
FIG. 7 is a perspective view of a modified seat.

The seat 96 is modified to include a flexible back flap 121 that extends up from the rear part of the seat, as shown in FIG. 7. The back flap 121 has a pair of pockets 123, 125 along the top portion of its sides 127, 129 into which the upper ends 131, 133 of the legs 112, 113 are inserted to hold the back flap 121 in place. If desired, the upper end portions 131, 133 of the legs 112, 113 can be angled slightly to the back to form a more comfortable back for the chair. The upper portions of the rear vertical legs 112, 113 and the back flap 121 on the seat 96 form the back rest 111 of the chair. Having the legs 112, 113 anchored in both the lower back and upper back pads 23C, 23D, 23E and 23F ensures a firm support for the back rest 111.

When the chair is folded up, the back legs 112, 113 remain parallel to reach other and move toward each other while the upper back pads 23E, 23F slide up on the legs as the sides and the front and back of the chair move together.

The chair 1 with the back rest 111 and hand rests 95 can be provided with two arm rests. The arm rests 137, as shown in FIG. 8, would each comprise a strip 139 of flexible fabric having a transverse pocket 141 at the front end 142 that receives a hand rest 95 on one of the front legs 5, 7, and a grommet 143 at its back end 145 by means of which it is slipped over one of the back legs 112, 113 behind the hand rest. A pin (not shown) passed through the back leg 112, 113 above the seat 96 can hold the back end 145 of the arm rest in place on the back leg. The arm rest 137 is pulled tight when the chair is unfolded, extending generally horizontally, parallel to side of the chair as shown in FIG. 1. The arm rest 137 folds up as the chair folds.

The chair embodiments described above are single seat chairs. However, the chair can be modified to provide double seats. In a double seat embodiment the chair has a frame comprising two pairs of crossed front legs, two pairs of crossed back legs and three pairs of crossed side legs. Both seats share a single pair of crossed side legs located between them. This middle pair of crossed side legs is pivotally mounted in middle connector pads that are modified to mount the front and back pairs of crossed legs of both seat portions. The double seat chair has hand rests on either side of the chair formed by extensions on the outside top end of the crossed leg in each front pair of crossed legs. The double seat chair also has a back rest for each seat, the back rests sharing a central back, vertical leg.

Figure 9:
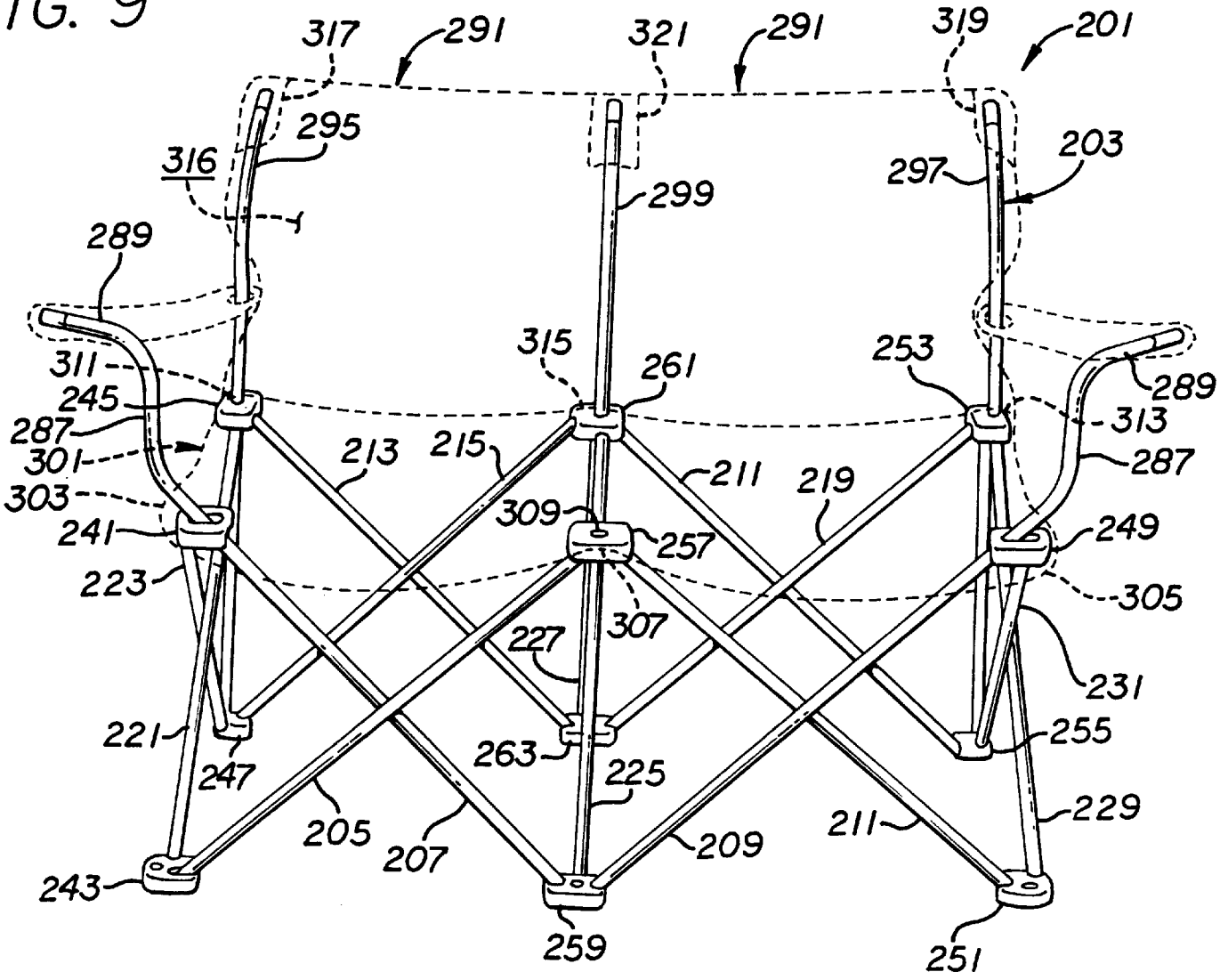
FIG. 9 is a front perspective view of a folding two seat chair in the unfolded position.

In more detail, as shown in FIG. 9, the double seat chair 201 has a frame 203, the frame 203 consisting of a first pair of crossed front legs 205, 207; a second pair of front crossed legs 209, 211; a first pair of crossed back legs 213, 215; a second pair of crossed back legs 217, 219; and three pairs of crossed side legs 221, 223; 225, 227; and 229, 231. The first outside pair of crossed side legs 221, 223 are connected to the ends of the first pair of crossed front legs 205, 207 by outer, front, upper and lower connector pads 241, 243. The first outside pair of crossed side legs 221, 223 are also connected to the ends of the first pair of crossed back legs 213, 215 by outer, back, upper and lower connector pads 245, 247. The second outside pair of crossed side legs 229,231 are connected to the outside ends of the second pair of crossed front legs 209, 211 by outer, front upper and lower connector pads 249, 251. The second outside pair of crossed side legs 229, 231 are also connected to the outside ends of the second pair of crossed back legs 217, 219 by outer, back upper and lower connector pads 253, 255. The third middle pair of crossed side legs 229, 231 are connected at their front ends to the inside ends of the first and second pairs of crossed front legs 205, 207 and 209, 211 by middle, front upper and lower connector pads 257, 259. The third middle pair of crossed side legs 229, 231 are also connected at their back ends to the inside ends of the first and second pairs of crossed back legs 213, 215 and 217, 219 by middle back upper and lower connector pads 261, 263.

The outer, front and back upper and lower connector pads 243 to 247 and 251 to 255, are the same as the connector pads 23 used in the single seat chair and the pads 241, 249 are the same as pads 25. The middle, front and back upper and lower connector pads 257 to 263 however have two slots 75, 77 and a through hole 79 plus an additional slot 265 in a third side surface 69 of the pad, the slot 265 extending into the main surface 61. This third slot 265 is offset from the slot 75 opposite to it. The through hole 79 is more centered in this pad. The three slots 75, 77, 265 allow three crossed legs to be connected to the pad by pivot pins and the through hole 79 allows a vertical leg, if used, to be connected to the pad as will be described.

The connector pads 241, 249 on the outer, upper, front corners of the chair have the through slot 77A which allows an extension 287 on the upper outer end of the crossed legs 207, 209 of the front pairs to slide through the connector pad. The extension 287 is bent as before to form a hand rest 289.

Preferably the double seat chair also has a back rest 291 for each seat. The back rests 291 include vertical legs 295, 297, 299 at each back corner and in the middle of the back. The vertical legs are mounted in the through holes 79 in the bottom connector pads 247, 263, 255 and slide through the upper back connector pads 245, 261, 253.

The seat 301 for the double seat chair, shown in dotted lines in FIG. 9 is made in one piece with grommets (not shown) on the front corners 303, 305 and in the front middle 307. A pin 309 connects the front middle grommet 307 to the middle, front upper connector block 257. Without back rests the seat 301 is connected by pins (not shown) through grommets (not shown) to the rear corners 311, 313 and the rear middle 315. With back rests 291, a back flap 315 is provided on the seat 301 with corner and middle pockets 317, 319, 321 for receiving the upper ends of the vertical back legs 295, 297, 299. The grommets on the back corners and in the back middle of the seat slide over the back vertical legs.

The seat 301 limits the amount the chair can unfold. The chair is unfolded by grasping the hand rests 289 and pulling them apart, the chair unfolding in both the X and Y directions and away from the middle pair of crossed side legs.

While a two seat has been described a three seat chair could be made in a similar manner.

In all embodiments the chair folds into a compact space and can be inserted into a flexible, tubular carrying bag for transport.

I claim:

1. A folding chair comprising:

a frame comprised of a pair of front crossed legs;

a pair of back crossed legs;

and two pairs of side crossed legs, each pair of crossed legs pivotally connected together where they cross;

the lower ends of the front crossed legs and the lower, front ends of the side crossed legs pivotally connected to first and second lower, front pads;

the lower ends of the back crossed legs and the lower, back ends of the side legs pivotally connected to first and second lower, back pads;

the lower front pads and the lower back pads acting to support the folding chair on the ground surface;

the upper ends of the back legs and the upper, back ends of the side legs pivotally connected to first and second upper, back pads;

the upper, front ends of the side legs pivotally connected to first and second upper, front pads;

the front legs extending continuously from the lower front pads and passing through the first and second upper front pads, the upper ends of the lower front legs bent to form hand rests above the upper front pads;

a flexible seat means connected to the frame with the corners of the seat means at the four upper pads;

the lower, front pads, the lower back pads and the upper back pads are substantially similar, each having parallel main faces joined by four side faces;

a hole extending through the pad transversely between the main faces;

a first slot extending inwardly from the main face and one side face, the slot parallel to a second side face adjacent the one side face;

and, a second slot extending inwardly from the one main face and a third side face, adjacent the one side face, the second slot transverse to the first slot, the slots just wide enough to receive the frame legs.

2. A folding chair as claimed in claim 1 including a pair of rear legs, substantially parallel to each other, the bottoms of the rear legs connected within an opening formed through the upper surface of the lower, back pads, the rear legs slidably passing through the upper, back pads.

3. A folding chair as claimed in claim 2 wherein the seat means includes a back flap extending upwards from the rear of the seat means, the seat means having two pocket means for attaching the flap to the frame by hooking over the upper ends of the rear legs.

4. A folding chair as claimed in claim 2 including flexible armrests, the armrests slidably connected to the rear legs and having pocket means at their end for hooking over the hand rests on the extensions of the upper ends of the front legs.

5. A folding chair as claimed in claim 1 wherein the first slot in the one side face is closely adjacent the second adjacent side face, and the second slot in the third side face is generally centered therein.

6. A folding chair as claimed in claim 1 wherein the seat means includes a back flap extending up from the rear of a seat means, a back means having a pocket means hooked over the top of the upper ends of the rear legs.

7. A folding chair as claimed in claim 1 wherein the second slot is spaced approximately the thickness of a frame leg from the one side face.

* * * * *